US006717606B2

(12) United States Patent
Masuda

(10) Patent No.: US 6,717,606 B2
(45) Date of Patent: Apr. 6, 2004

(54) OPTICAL PRINT HEAD AND IMAGE FORMING APPARATUS USING A ROD LENS WITH A PREDETERMINED CONJUGATE LENGTH

(75) Inventor: Koji Masuda, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 09/987,553

(22) Filed: Nov. 15, 2001

(65) Prior Publication Data

US 2002/0057329 A1 May 16, 2002

(30) Foreign Application Priority Data

Nov. 15, 2000 (JP) ..... 2000-348074

(51) Int. Cl.[7] ..... B41J 27/00
(52) U.S. Cl. ..... 347/244; 347/258
(58) Field of Search ..... 347/238, 241, 347/244, 256, 258, 232; 250/208.1; 385/120

(56) References Cited

U.S. PATENT DOCUMENTS 5,933,181 A * 8/1999 Shimizu et al. ..... 347/232
6,169,564 B1 * 1/2001 Tsukagoshi et al. ..... 347/238
6,449,414 B1 * 9/2002 Tahara et al. ..... 385/120
6,473,111 B1 * 10/2002 Fukasawa ..... 347/241
6,563,104 B2 * 5/2003 Ogi et al. ..... 250/208.1

FOREIGN PATENT DOCUMENTS

JP 54-124747 * 9/1979 ..... G02B/27/00

* cited by examiner

*Primary Examiner*—Hai Pham
(74) *Attorney, Agent, or Firm*—Oblon, Spivak, McClelland, Maier & Neustadt, P.C.

(57) ABSTRACT

An optical print head of the present invention includes a light emitting element array having of a plurality of light emitting elements. A rod lens array has a plurality of rod lenses for focusing light output from the rod lenses on an image carrier in the form of beam spots. The rod lenses each have a conjugate length greater than a distance between the light emitting element array, which forms a x1 image, and the image carrier. The head of the present invention reduces the diameter of a beam spot and positions a beam waist close to the image carrier to thereby increase resolution. An image forming apparatus using the above head is also disclosed.

10 Claims, 12 Drawing Sheets

OPTICAL PRINT HEAD AND IMAGE FORMING APPARATUS USING A ROD LENS WITH A PREDETERMINED CONJUGATE LENGTH

BACKGROUND OF THE INVENTION

1. Field of the Invention

The present invention relates to an optical print head using a light emitting element array and a rod lens array and an image forming apparatus using the optical print head as an exposing unit.

2. Description of the Background Art

Today, there is an increasing demand for a miniature, digital optical writing unit that meets the current trend toward a miniature digital copier, printer, digital facsimile apparatus or similar digital image forming apparatus. Digital writing is practicable with either one of an optical scanning system and a solid-state writing system. The optical scanning system uses a semiconductor laser or similar light source, an optical deflector, and a lens. The optical deflector deflects light issuing from the light source while the lens focuses the deflected light in the form of a beam spot. The solid-state writing system uses an LED (Light Emitting Diode) array, organic EL (Electro Luminescence) device array or similar light emitting element array. A focusing element array focuses light issuing from the light emitting element array in the form of beam spots. While the optical scanning system needs a long optical path due to the deflector, the solid-state writing system makes the optical path extremely short and is therefore suitable for the miniaturization of an optical writing unit.

Generally, the focusing element array included in an optical print head is implemented as a rod lens array having a number of graded-index rod lenses arranged in two or more arrays. Japanese Patent Laid-Open Publication No. 5-138934, for example, proposes a method of producing an optical print head. This method equalizes a distance between a light emitting element array and an image carrier and the conjugate length of the individual rod lens of a rod lens array. In this condition, the rod lens array can be accurately positioned at the center between the light emitting element array and the image carrier.

However, optical simulations for measuring a beam spot diameter with respect to a defocus showed the following. When the distance between the light emitting element array and the image carrier was the same as the conjugate length of the individual rod lens, the beam spot diameter could not be sufficiently reduces. Moreover, a beam waist where the beam spot diameter becomes smallest with respect to the defocus was shifted from the image carrier.

On the other hand, Japanese Patent Laid-Open Publication No. 6-320790 discloses an optical print head constructed to guarantee MTF (Modulation Transfer Function) of 50% or above for irregularity in the height of an emitting region (+0.2 mm). For this purpose, the above document teaches that a distance between the average height of the emitting regions of LEDs and the center of a lens array is greater than the resonance length of the lens array. This kind of scheme has the following problem left unsolved. Assume that the distance between the average height of the light emitting regions of LEDs and the center of the lens array is greater than one half of the conjugate length of the rod lens array. Then, MTF is lowered although it varies little with respect to irregularity in the height of the emitting region, failing to increase the resolution of the focusing element array.

SUMMARY OF THE INVENTION

It is therefore an object of the present invention to provide an optical print head capable of increasing resolution by reducing a beam spot diameter and positioning a beam waist in the vicinity of an image carrier.

It is another object of the present invention to provide an image forming apparatus using the above optical print head as an exposing unit.

In accordance with the present invention, an optical print head includes a light emitting element array having a plurality of light emitting elements. A rod lens array has a plurality of rod lenses for focusing light output from the rod lenses on an image carrier in a form of beam spots. The rod lenses each have a conjugate length greater than a distance between the light emitting element array, which forms a x1 image, and the image carrier.

Also, in accordance with the present invention, an image forming apparatus includes an image carrier for forming a latent image thereon, and an exposing unit including an optical print head for forming the latent image on the image carrier. The optical print head has the above-described unique configuration.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
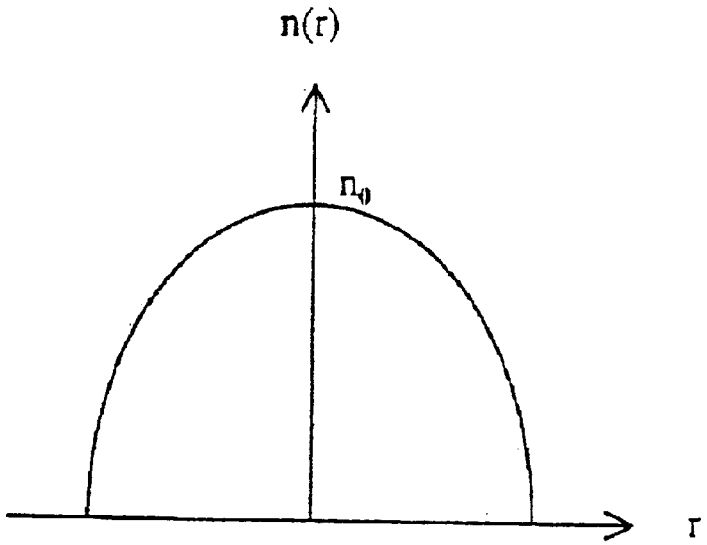
FIG. 1 PRIOR ART
FIG. 1 shows a specific refractive index profile of a rod lens.

To better understand the present invention, brief reference will be made to a rod lens array made up of graded-index rod lenses and applied to an optical print head. FIG. 1 shows the refractive-index profile of a rod lens. As shown, the refractive-index profile is parabolic with respect to a distance r from the center of a rod lens and expressed by approximation as:

$$n(r)=n_0(1-A/2\times r^2)$$

where $n_0$ denotes a refractive index on the axis determined by the material of the rod lens and the emission wavelength of a light emitting element, and A denotes a refractive-index profile constant.

Figure 2:
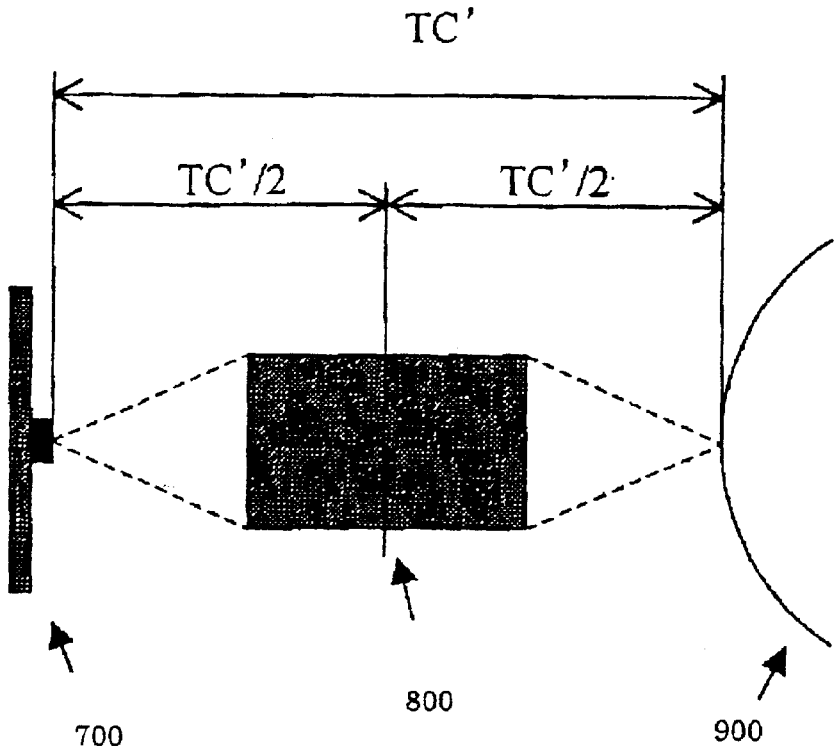
FIG. 2 PRIOR ART
FIG. 2 is a section showing a specific configuration of a conventional optical print head.

FIG. 2 shows a specific configuration of a conventional optical print head. As shown, the optical print head includes a light emitting element array 700, a rod lens array 800, and an image carrier 900. The rod lens array 800 is made up of rod lenses whose conjugate length is TC'. To focus a x1 image via the rod lens array 800, it is necessary that the distance between the light emitting element array 700 and the image carrier 800 be equal to the conjugate length TC' of the rod lenses. Further, MTF is degraded, i.e., the beam spot diameter cannot be reduced unless the rod lens array 800 is accurately positioned at the center between the light emitting element array 700 and the image carrier 900.

Figure 3:
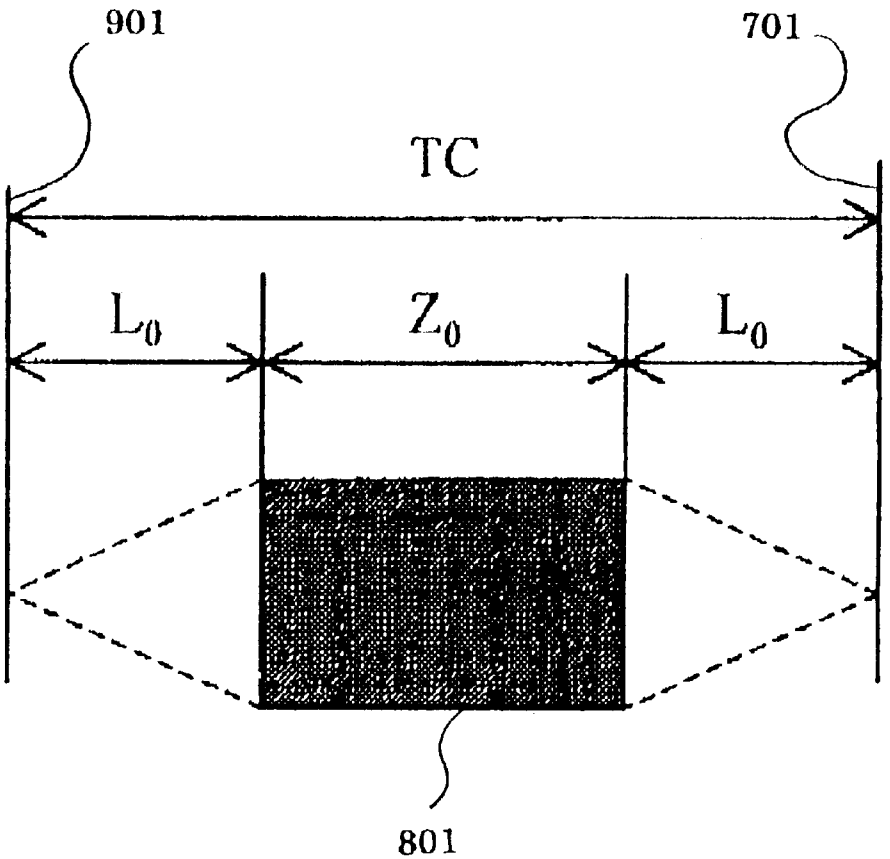
FIG. 3 PRIOR ART
FIG. 3 is a section for describing the conjugate length of a rod lens.

As shown in FIG. 3, assume that a rod lens array 801 has rod lenses each having a length of $Z_0$, that the rod lens array 801 and an object plane 701 are spaced from each other by a distance of $L_0$ (operation distance at the object side), and that the rod lens array 801 and an image plane 901 are spaced from each other by a distance of $L_0$ (operation distance at the image side). Then, the conjugate length TC of the rod lenses is produced by:

$$TC=Z_0+2L_0$$

The distance $L_0$ is expressed as:

$$L_0=-1/(n_0\sqrt{A})\times\tan(Z_0\sqrt{A}/2)$$

The conjugate length TC is therefore produced by:

$$TC=Z_0-2/(n_0\sqrt{A})\times\tan(Z_0\sqrt{A}/2)$$

It follows that the conjugate length TC can be calculated by using the lens length $Z_0$ and refractive-index profile constant A. Assume that the magnification M of the rod lenses is 1 (non-inverted x1 image). Then, $Z_0$ and A are determined on the basis of the magnification M, deriving $L_0$ and TC.

Figure 4:
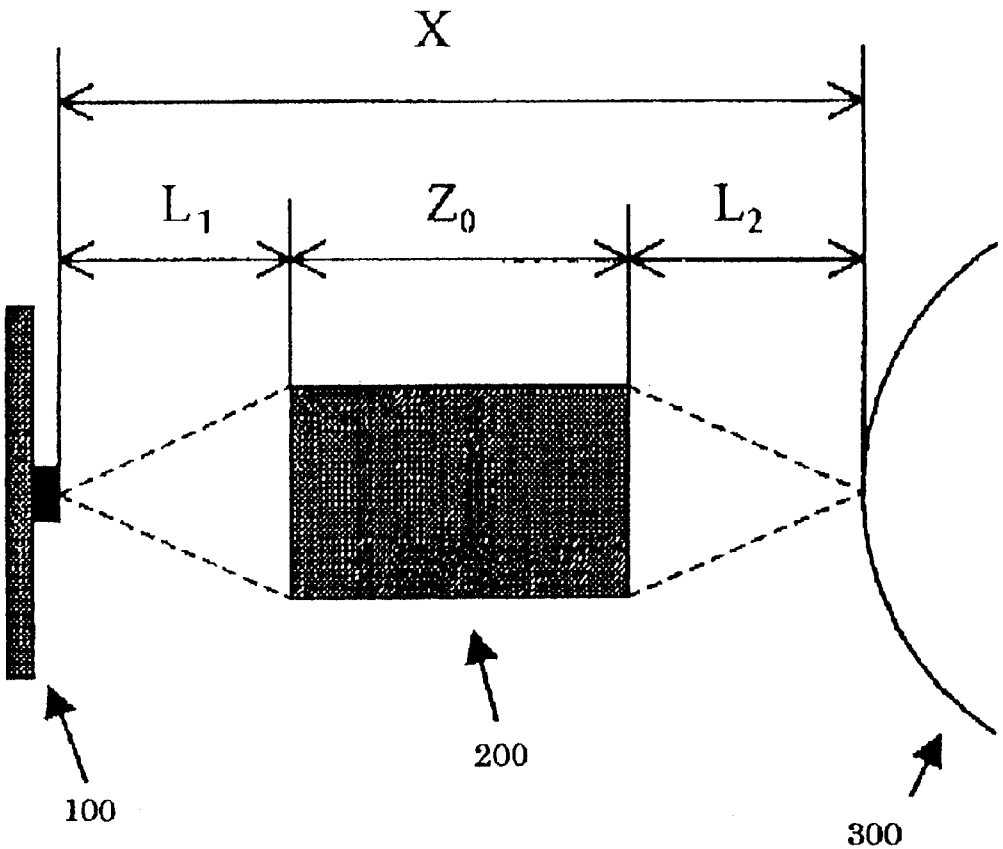
FIG. 4 is a section showing an optical print head embodying the present invention.

Referring to FIG. 4, an optical print head embodying the present invention will be described. As shown, the print head includes a light emitting element array 100 and a rod lens array 200. In FIG. 4, the reference numeral 300 designates an image carrier included in an image forming apparatus.

Figure 5A:
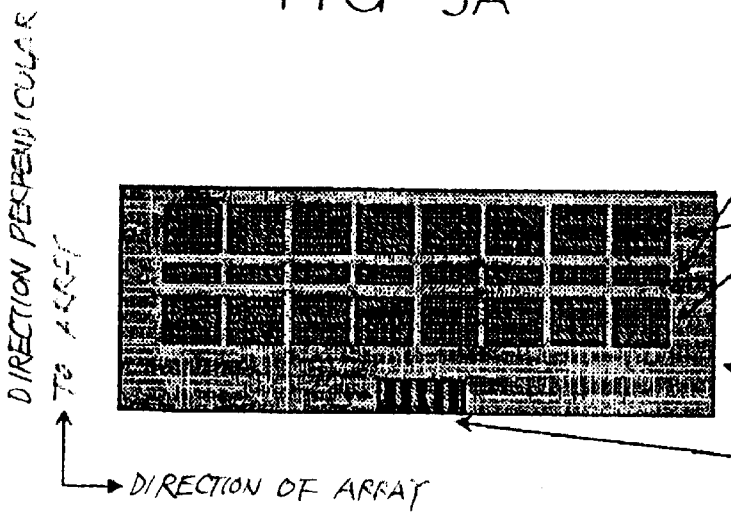
FIG. 5A is a front view showing an LED array included in the illustrative embodiment.
Figure 5B:
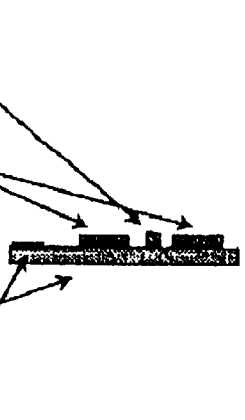
FIG. 5B is a section of the LED array.

FIGS. 5A and 5B show a specific configuration of the light emitting element array 100. As shown, a plurality of LED array chips 140 are arranged on a circuit board 110. Driver ICs (Integrated Circuits) 130 are mounted on the circuit board 110 at both sides (or one side) of the chips 140. A connector 120 is additionally arranged on the circuit board 110 for connecting signal cables to the driver ICs 130, so that an image signal and other information can be fed to the driver ICs 130.

Figure 5C:
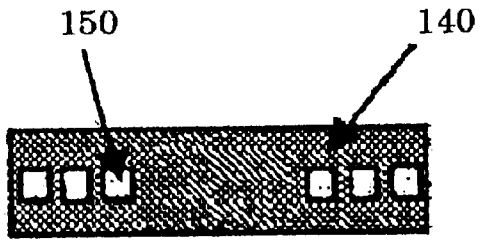
FIG. 5C is a front view of an LED array chip.

As shown in FIG. 5C, a plurality of LEDs 150 are arranged on each LED chip 140. Generally, several ten to several hundred LEDs are arranged on a single LED array chip while several ten LED array chips 140 are arranged on a circuit board. For example, to print an image of size A4 with resolution of 600 dpi (dots per inch), it has been customary to arrange 128 LEDs on each LED array chip and to mount forty LED array chips on a circuit board; 5,120 (128×40) LEDs exist in total.

Figure 6A:
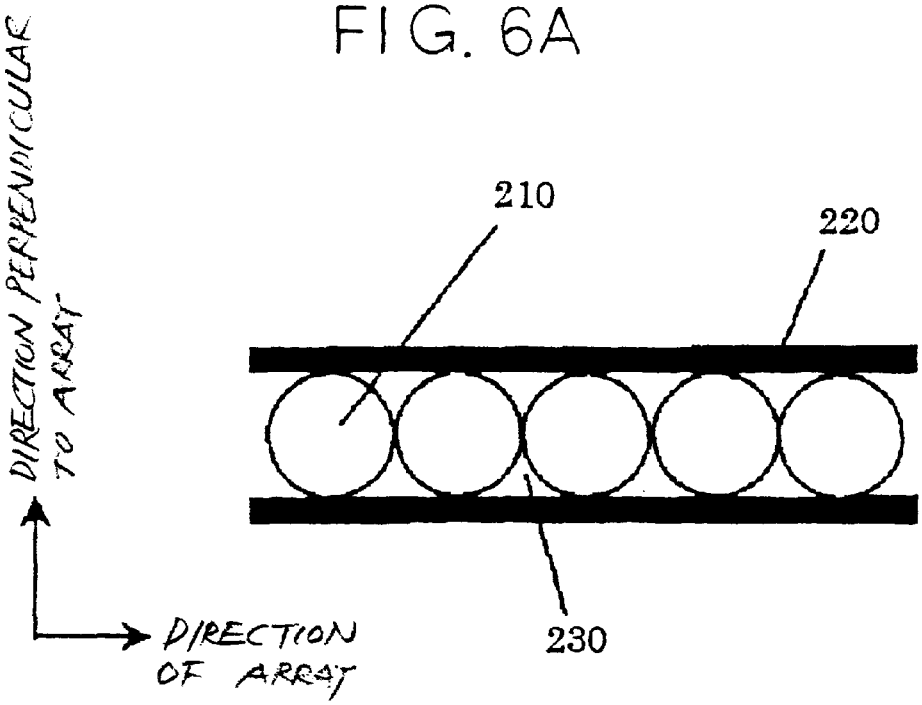
FIG. 6A is a front view showing a specific arrangement of a rod lens array also included in the illustrative embodiment.
Figure 6B:
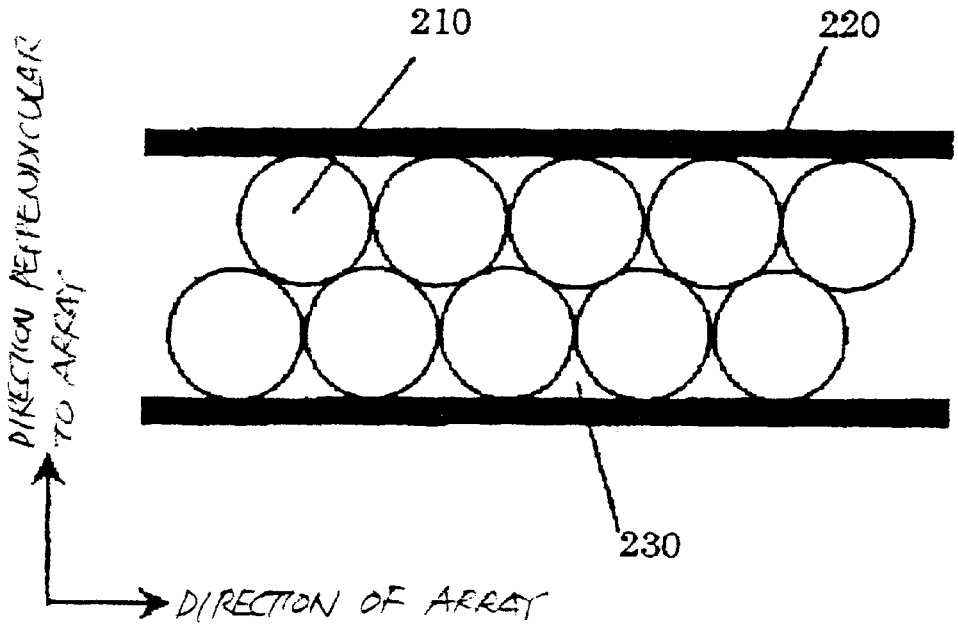
FIG. 6B is a front view showing another specific arrangement of the rod lens array.

A rod lens array has graded-index rod lenses arranged in a single array or a plurality of arrays. Specifically, FIG. 6A shows rod lenses 210 arranged in a single array while FIG. 6B shows the rod lenses 210 arranged in two arrays shifted from each other. If desired, the rod lenses may be arranged in three arrays or in arrays not shifted from each other.

Opposite side plates 220 support the rod lenses 210 at both sides of the lenses 210 for providing them with mechanical strength. Adhesive 230 fills the gaps between the rod lenses 210 in order to firmly connect the lenses 210 together. The adhesive 230 is opaque and serves to obviate flare at the same time.

The rod lens array 200 shown in FIG. 4 has rod lenses arranged in two shifted arrays. In FIG. 4, assume that the light emitting element array 100 and the incidence surface of the rod lens array 200 are spaced by a distance of $L_1$, that the rod lenses constituting the array 200 have a length of $Z_0$ each, and that the array 200 and the image carrier 300 are spaced from each other by a distance of $L_2$. Further, assume that the axis of the individual rod lens has a refractive index of $n_0$, that the rod lens has a diameter of D, and that a refractive-index profile constant is A.

The focusing characteristics of the illustrative embodiment and those of a comparative example, which implements a x1 image, will be compared by using the results of optical simulations. Because the positional relation between the light emitting element array 100 and the image carrier 300 is fixed beforehand, focusing characteristics are determined by factors particular to the rod lens. In both of the illustrative embodiment and comparative example, the refractive index $n_0$ and diameter D of the individual rod lens are 1.627 and 0.60 mm, respectively.

Assume that the individual rod lens has a length of $Z'_0$ that is 5.80 mm. Then, in the comparative example, if $L'_1=L'_2=3.00$ holds, then the distance X' between the light emitting element array 100 and the image carrier 300 is produced by:

$$X'=Z'_0+L'_1+L'_2=11.80\text{ mm}$$

Therefore, assuming that the conjugate length of the rod lens is TC', then a refractive-index profile constant A' should be determined such that TC'=X'=11.80 (mm) is satisfied. At this instant, $(\sqrt{A})'=0.6473475$ holds.

By contrast, the illustrative embodiment selects a refractive-index profile constant A of $\sqrt{A}=0.6419$, which is smaller than the above-mentioned constant A'. The illustrative embodiment is identical with the comparative example as to the other factors of the rod lens, i.e., $Z_0=Z'_0=5.80$ mm, $n_0=1.627$, and D=0.60 mm. At this instant, the distances $L_1$ and $L_2$ both are 3.20 mm while the conjugate length TC is 12.20 mm. The magnification M is 1.13.

As stated above, the conjugate length TC of the illustrative embodiment is greater than the conjugate length TC' of the comparative example. A ratio TC/TC' is 1.034.

Figure 7:
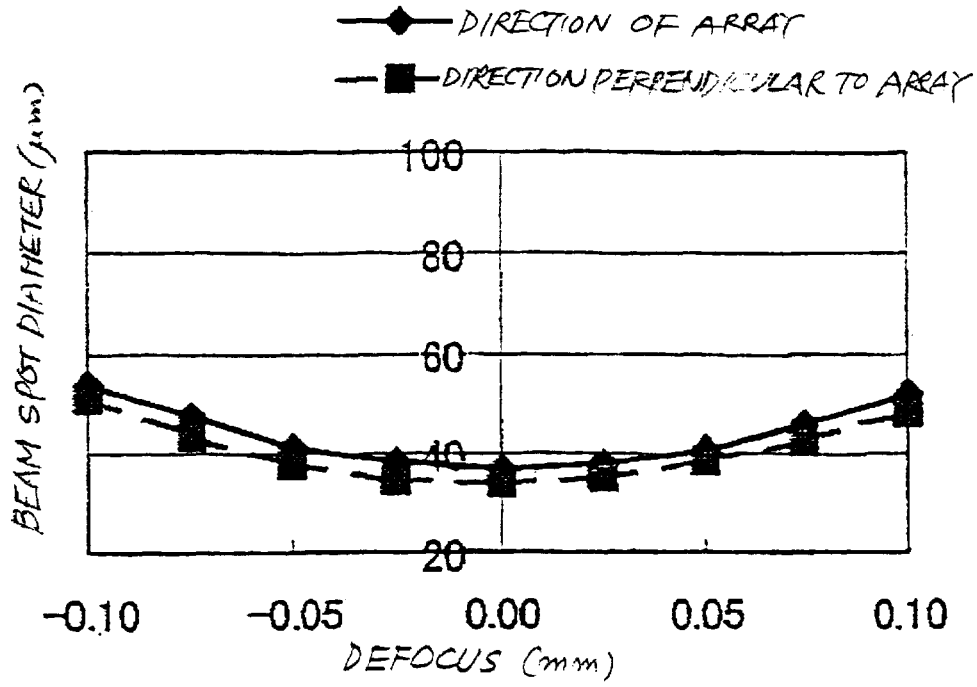
FIG. 7 is a graph showing a relation between a defocus and a beam spot diameter unique to the illustrative embodiment, as determined by optical simulations.
Figure 8:
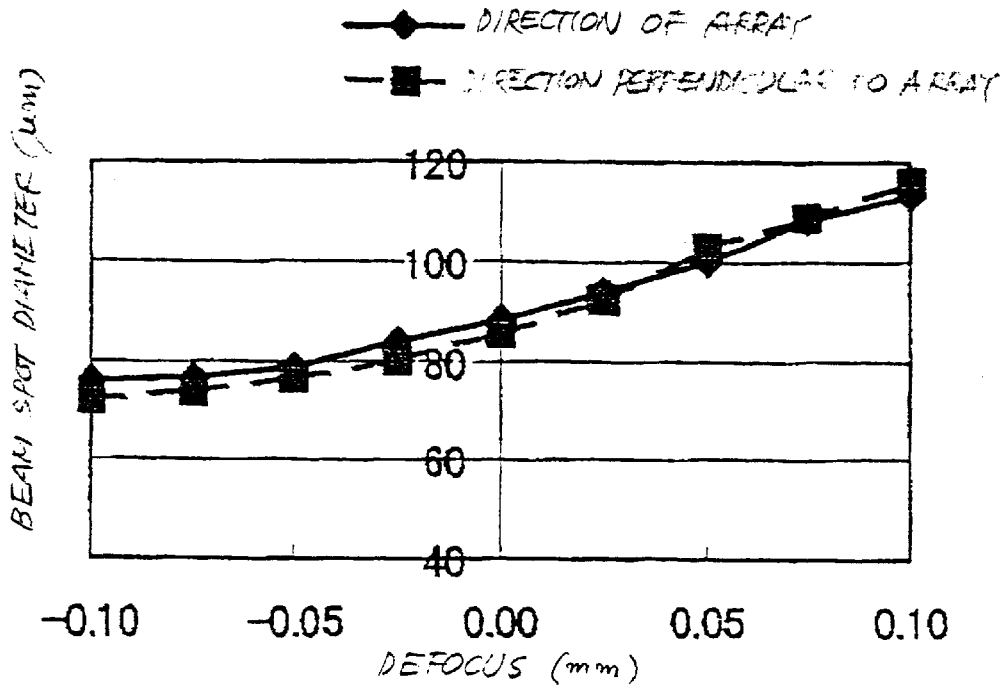
FIG. 8 is a graph showing a relation between the defocus and the beam spot diameter particular to a comparative example, as also determined by optical simulations.
Figure 9:
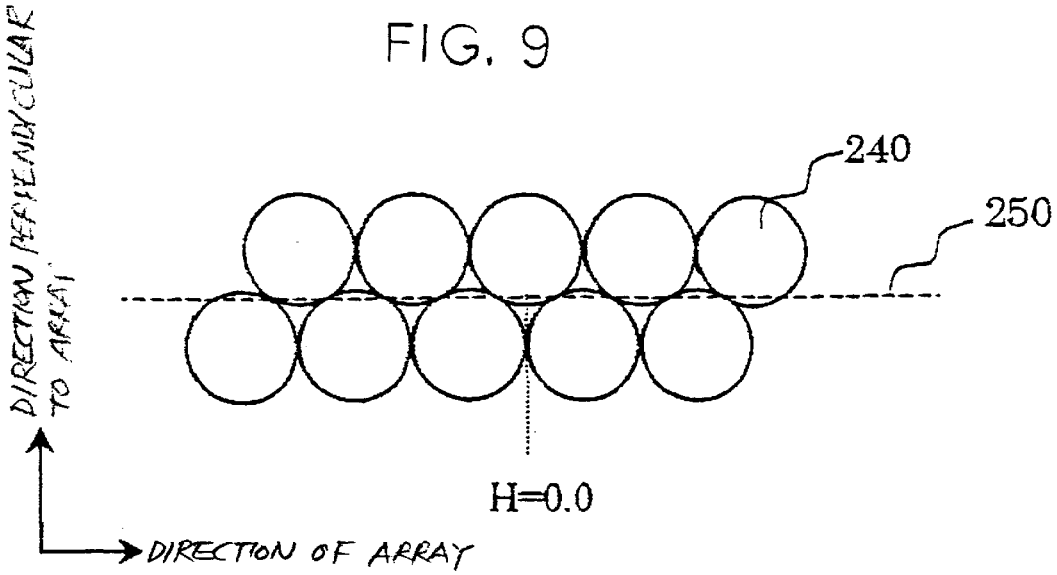
FIG. 9 is a front view showing the position of a light source relative to the rod lens array of the illustrative embodiment.

FIGS. 7 and 8 compare the illustrative embodiment and comparative example as to a relation between a defocus and a beam spot diameter, as determined by optical simulations. For the simulations, the light emitting elements were implemented as LEDs with resolution of 600 dpi and constituting a 20 $\mu$m square, perfect-diffusion light source. FIG. 9 shows the position of the light source relative to the rod lens array 200. As shown, assume that rod lenses 240 are arranged in two arrays shifted from each other. Then, the light source faces the center 250 of the rod lens array 200 in a direction perpendicular to the direction of the arrays. More specifically, assuming that an object height in the direction of arrangement of the rod lenses 240 is H, then the object height H was selected to be 0.0 mm.

In FIG. 8 that relates to the comparative example, the beam spot diameter is not reduced at a position where the defocus is 0.0 mm. In addition, a beam waist is shifted to the negative focus side. By contrast, as shown in FIG. 7, the illustrative embodiment successfully reduces the beam spot size to 35 $\mu$m at the defocus of 0.0 mm and realizes a beam waist coinciding with the defocus of 0.0 mm, achieving desirable focusing characteristics.

Figure 10:
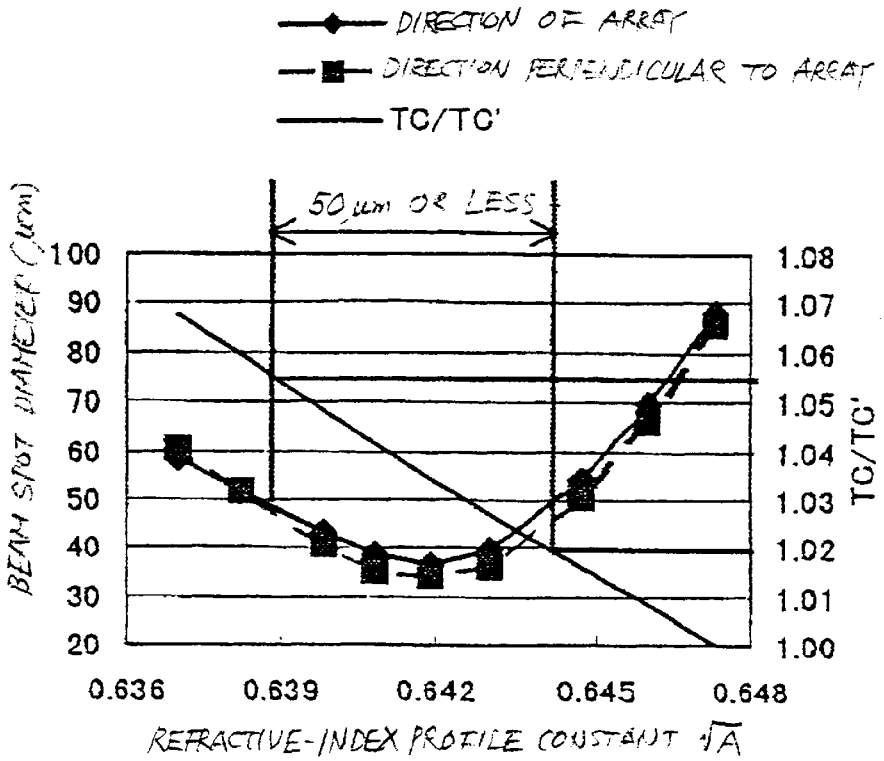
FIG. 10 is a graph showing a relation between a refractive-index profile constant and the beam spot diameter achievable with the illustrative embodiment, as determined by optical simulations.

FIG. 10 shows the results of optical simulations as to the beam spot diameter relative to $\sqrt{A}$ and TC/TC' relative to $\sqrt{A}$ determined at the defocus of 0.0 mm and H of 0.0 mm. For the simulations, the refractive-index profile constant A was sequentially reduced from one that implemented a x1 image. A pixel pitch at the resolution of 600 dpi is 42.3 $\mu$m. To implement high resolution, a beam spot diameter at a $1/e^2$ threshold level should preferably be 50 $\mu$m or less. Therefore, as FIG. 10 indicates, the following condition should preferably be satisfied in order to achieve a desirable beam spot diameter:

$$TC/TC' \geqq 1.02$$

Further, a difference $\Delta$ in refractive index between the center and the most peripheral portion of a lens is expressed as:

$$\Delta = n(r=D/2) - n(r=0)$$

The difference $\Delta$ is 0.04700 when $\sqrt{A}$ is 0.6419 (embodiment) or 0.04740 when $\sqrt{A}$ is 0.6473475 (comparative example). By reducing the refractive-index profile constant A, it is possible to reduce the above difference $\Delta$ and therefore to reduce a tact time on a production line that sets up a refractive-index profile, thereby reducing a production cost. In addition, to desirably reduce the beam spot diameter, the ratio TC/TC' should preferably be smaller than or equal to 1.05.

As stated above, in the optical print head of the type including the light emitting element array 100 and rod lens array 200, the illustrative embodiment provides the individual rod lens with a conjugate length TC greater than the distance X' between the light emitting element array 100 and the image carrier 300. This successfully reduces the beam spot diameter to about 35 $\mu$m at the defocus of 0.0 mm and positions a beam waist at the defocus of 0.0 mm, thereby implementing desirable focusing characteristics.

Therefore, so long as the positional relation between the light emitting element array 100 and the image carrier 300 is fixed beforehand, the illustrative embodiment can reduce the beam spot diameter and can locate a beam waist in the vicinity of the image carrier 300. The resulting print head achieves high resolution. The illustrative embodiment can further reduce the beam spot diameter if the ratio of the conjugate length TC of the individual rod lens to the conjugate length TC', i.e., TC/TC' is greater than or equal to 1.02.

An alternative embodiment of the optical print head in accordance with the present invention will be described hereinafter in relation to the same comparative example. In the illustrative embodiment, the individual rod lens has a length $Z_0$ of 5.74 mm, a refractive index $n_0$ of 1.627 on the axis, a diameter D of 0.60 mm, and A (=A') of 0.6473475. Therefore, there hold $L_1=L_2=3.216$ mm and TC=12.172 mm. In this case, the magnification M is 1.14.

The factors of the rod lens that implement a x1 image are the same as described previously. Therefore, there holds TC=TC'=11.80 mm. Consequently, the conjugate length TC of the rod lens of the illustrative embodiment is greater than the conjugate length TC' of the comparative example. The ratio TC/TC' is 1.031.

The illustrative embodiment provides the individual rod lens with a length $Z_0$ smaller than the length $Z'_0$ that implements a x1 image, thereby setting up a conjugate length TC greater than the conjugate length TC' implementing a x1 image.

Figure 11:
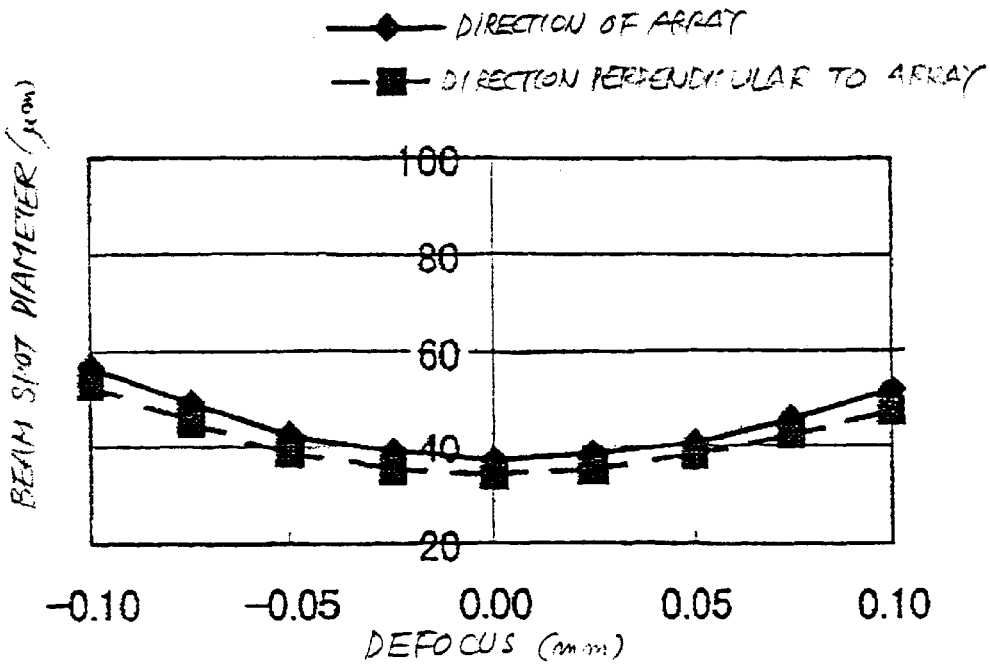
FIG. 11 is a graph showing a relation between the defocus and the beam spot diameter also unique to the illustrative embodiment, as determined by optical simulations.

FIG. 11 shows a relation between defocus and the beam spot diameter particular to the illustrative embodiment, as determined by optical simulations. For the simulations, there were assumed LEDs with resolution of 600 dpi and constituting a 20 $\mu$m square, perfect diffusion light source. In addition, the position H of the light source relative to the rod lens array 200 was selected to be 0.0 mm. As FIG. 11 indicates, the beam spot diameter is reduced to about 35 $\mu$m at the defocus of 0.0 mm while the beam waist is also coincident with the defocus of 0.0 mm. The illustrative embodiment therefore also achieves desirable focusing characteristics.

Figure 12:
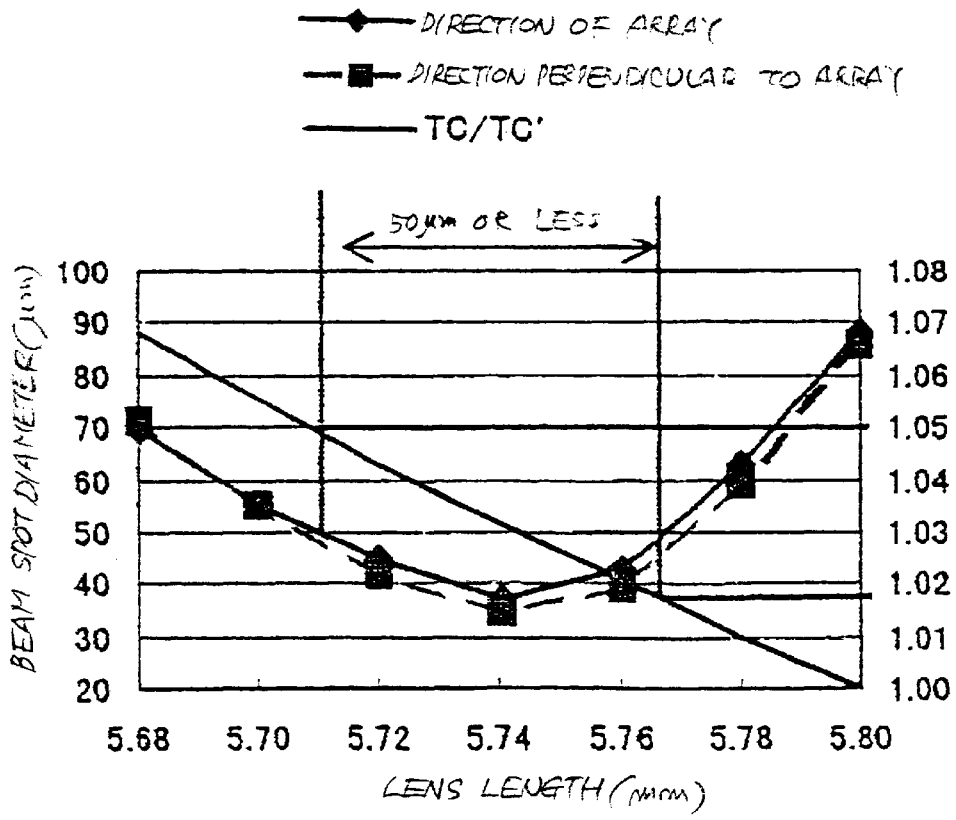
FIG. 12 is a graph showing a relation between the length of a rod lens and the beam spot diameter achievable with the illustrative embodiment, as determined by optical simulations.

FIG. 12 shows the results of optical simulations conducted to determine a relation between the length $Z_0$ of the rod lens and the beam spot diameter and a relation between the length $Z_0$ and the ratio TC/TC' with respect to the defocus of 0.0 mm and H of 0.0 mm. For the simulations, the length $Z_0$ was sequentially reduced from the length implementing a x1 image. It will be seen from FIG. 12 that to reduce the beam spot diameter to 50 $\mu$m or less, there should preferably be satisfied a relation:

$$TC/TC' \geqq 1.02$$

While the length $Z_0$ should preferably be reduced from the parts cost standpoint, there should preferably hold a relation of TC/TC'$\geqq$1.05 from the beam spot diameter standpoint.

Figure 13:
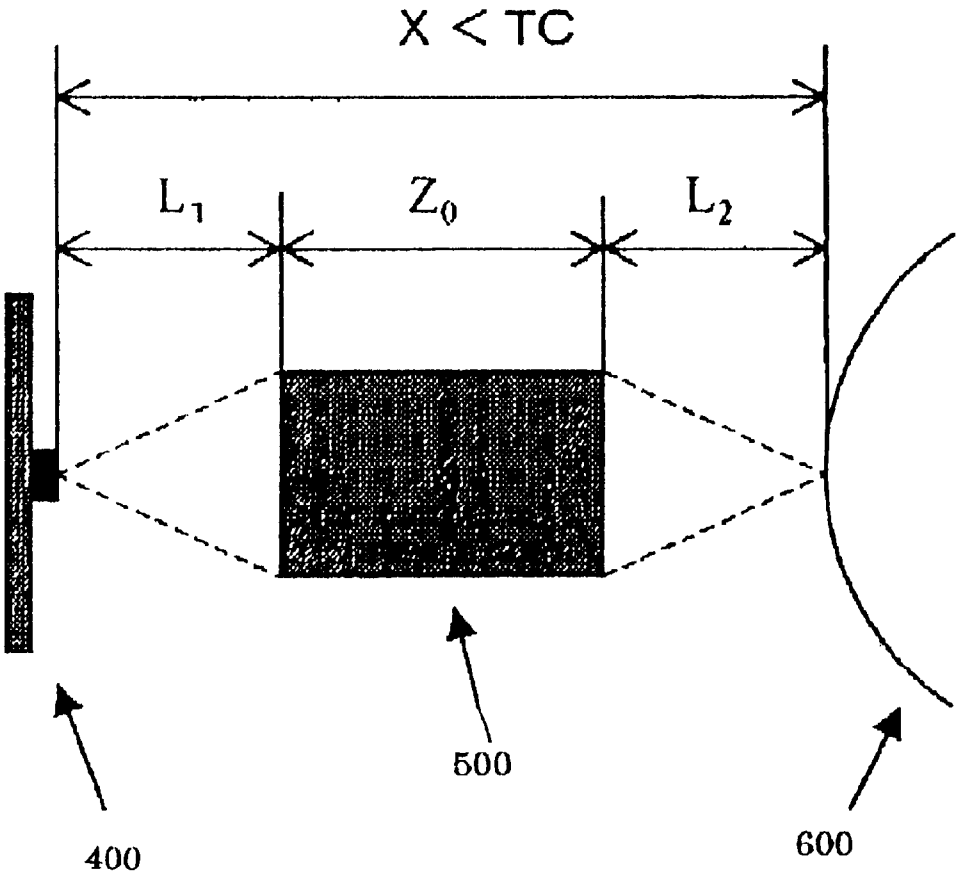
FIG. 13 is a section showing an alternative embodiment of the present invention.

Reference will be made to FIG. 13 for describing another alternative embodiment of the present invention. As shown, a light emitting element array 400 and the incidence surface of a rod lens array 500 are spaced from each other by a distance of $L_1$. The individual rod array of the rod lens array 500 has a length of $Z_0$. The rod lens array and an image carrier 600 are spaced from each other by a distance of $L_2$. Further, the individual rod lens has a refractive index of $n_0$, a diameter of D, and a refractive-index profile constant of A.

The focusing characteristics of the illustrative embodiment and those of the previously stated comparative example will be compared by using the results of optical simulations. Because the various factors of the individual rod lens are determined beforehand, the focusing characteristics are determined by the positional relation between the light emitting element array 400 and the image carrier 600.

Again, the individual rod lens is assumed to have $Z_0=Z'_0$ of 5.80 mm, A=A' of 0.6473475, $n_0$ of 1.627 and D of 0.60 mm as in the comparative example. Therefore, distances $L'_1$ and $L'_2$ implementing a x1 image each are 3.00 mm, as stated earlier. Further, the conjugate length TC of the rod lens is equal to the conjugate length TC' of the comparative example:

$$TC=TC'=X'=Z'_0+L'_1+L'_2=11.80 \text{ mm}$$

In the illustrative embodiment, the distances $L_1$ and $L_2$ are smaller than the distances $L'_1$ and $L'_2$ of the comparative example and assumed to be 2.80 mm each. Then, there holds:

$$X=Z_0+L_1+L_2=11.40 \text{ mm}$$

It follows that X<TC and X/TC=0.966 hold.

Figure 14:
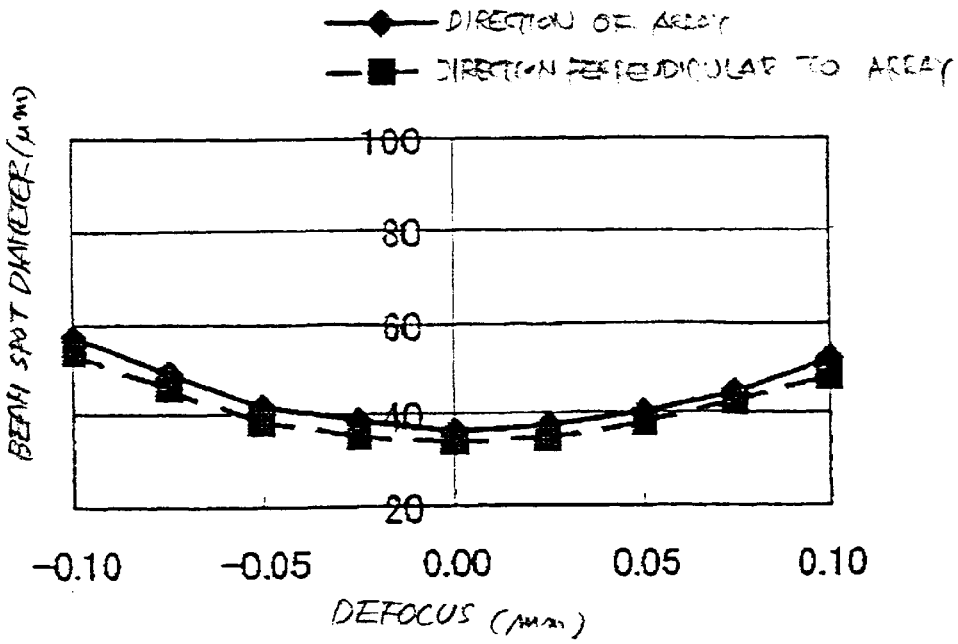
FIG. 14 is a graph showing a relation between the defocus and the beam spot diameter particular to the embodiment shown in FIG. 13.

FIG. 14 shows a relation between the defocus and the beam spot diameter particular to the illustrative embodiment, as determined by optical simulations. For the simulations, there were assumed LEDs with resolution of 600 dpi and constituting a 20 $\mu$m square, perfect diffusion light source. In addition, the position H of the light source relative to the rod lens array 500 was selected to be 0.0 mm. As FIG. 14 indicates, the beam spot diameter is reduced to about 35 $\mu$m at the defocus of 0.0 mm while the beam waist is also coincident with the defocus of 0.0 mm. The illustrative embodiment therefore also achieves desirable focusing characteristics.

Figure 15:
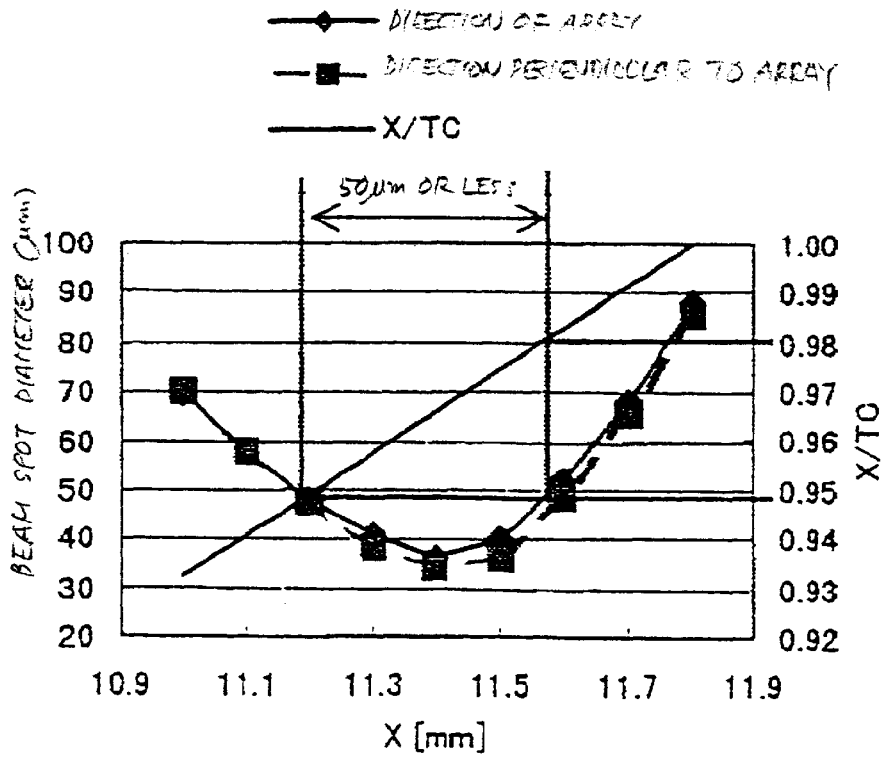
FIG. 15 is a graph showing a relation between a distance between the LED array and the image carrier and the beam spot diameter particular to the embodiment of FIG. 13, as determined by optical simulations.

FIG. 15 shows the results of optical simulations conducted to determine a relation between the distance X and the beam spot diameter and a relation between the distance X and the ratio X/TC with respect to the defocus of 0.0 mm and H of 0.0 mm. For the simulations, the distances $L_1$ and $L_2$ were sequentially reduced from the conjugate length TC of the rod lens for thereby reducing X. It will be seen from FIG. 15 that to reduce the beam spot diameter to 50 $\mu$m or less, there should preferably be satisfied a relation:

$$X/TC \leqq 0.98$$

However, a decrease in distances $L_1$ and $L_2$ directly translates into a decrease in the distance between the light emitting element array 400 and the rod lens array 500 and the distance between the print head and the image carrier 600, making assembly to difficult to perform. In light of this, to desirably reduce the beam spot diameter, there should preferably be satisfied a relation of $X/TC \geqq 0.95$.

As stated above, in the print head of the type including the light emitting element array and rod lens array 500, the illustrative embodiment makes the distance between the light emitting element array 400 and the image carrier 600 smaller than the conjugate length TC of the individual rod lens. So long as the various factors of the rod lens array 500 are fixed beforehand, the above configuration successfully reduces the beam spot diameter and positions the beam waist in the vicinity of the image carrier 600, thereby providing the print head with high resolution.

In the embodiments shown and described, the distance between the light emitting element array and the rod lens array (operation distance at the object side) and the distance between the rod lens array and the image carrier (operation distance at the image side) are equal to each other. Should the two distances of the rod lens array be different from each other, then MTF would be lowered to prevent the beam spot diameter from being reduced.

While the illustrative embodiments have concentrated on an LED array, the LED array may be replaced with any other suitable light source, e.g., an EL device array using organic EL devices that are also arranged in one or more arrays. Further, use may be made of an optical shutter array made up of a halogen lamp and a shutter array positioned in front of the halogen lamp and capable of being selectively opened and closed on a pixel basis.

An image forming apparatus using any one of the illustrative embodiments will be described with reference to FIG. 16. As shown, the image forming apparatus includes an image carrier implemented as a photoconductive drum 28. Arranged around the drum 28 are charging unit 20, an exposing unit 21, a developing unit 22, an image transferring unit 23, a cleaner unit 25, a discharging unit 26, and a fixing unit 24.

In operation, while the drum 28 is in rotation, the charging unit 20 uniformly charges the surface of the drum 28. The exposing unit 21 illuminates the charged surface of the drum 28 with beam spots to thereby form a latent image. The developing unit 22 deposits toner on the latent image for thereby producing a corresponding toner image. The image transferring unit 23 transfers the toner image to a sheet 27. The fixing unit 24 fixes the toner image on the sheet 27 with heat and pressure. After the image transfer, the cleaner unit 25 removes toner left on the drum 28. Further, the discharging unit 26 discharges the surface of the drum 28 cleaned by the cleaner unit 25. The exposing unit 21 includes the print head of any one of the embodiments shown and described.

Figure 17:
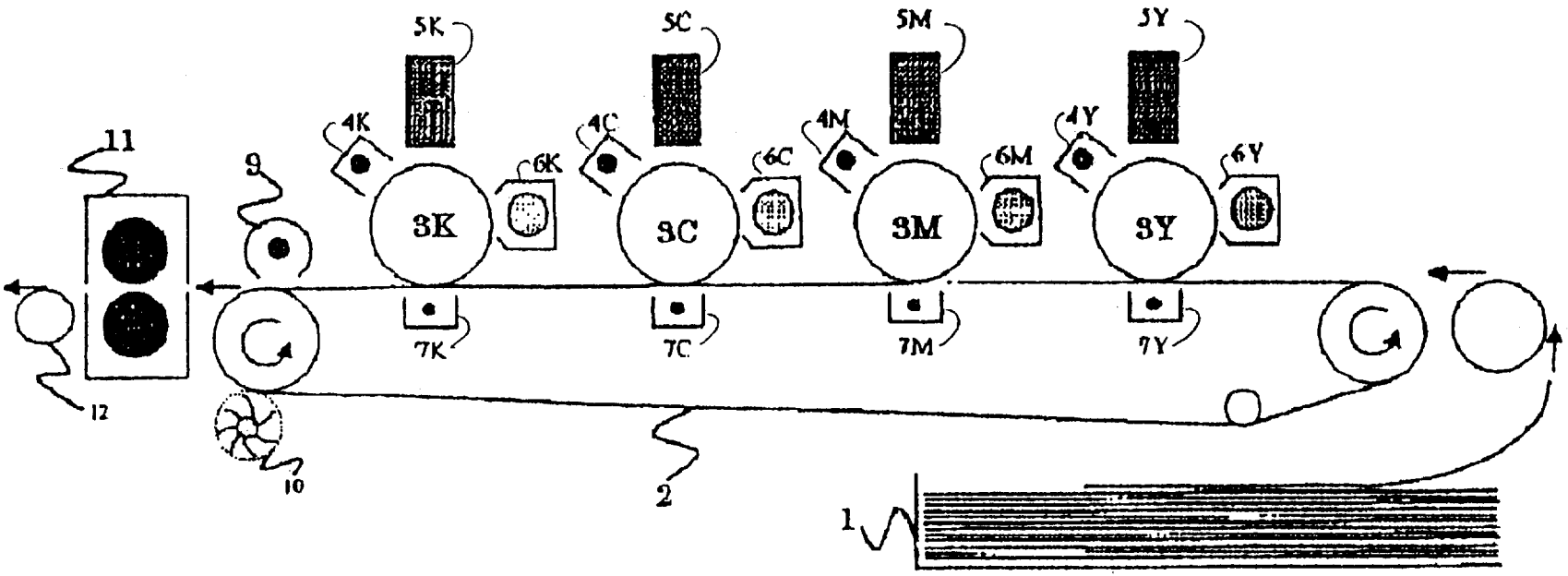
FIG. 17 shows another specific configuration of the image forming apparatus.

FIG. 17 shows another specific configuration of the image forming apparatus. The image forming apparatus to be described is implemented as a tandem image forming apparatus feasible for high-speed color image formation. As shown, the tandem image forming apparatus includes a sheet cassette 1, a belt conveyor 2, a discharging unit 9, a cleaning unit 10, a fixing unit 11, and an outlet roller 12. Photoconductive drums 3Y, 3M, 3C and 3K are sequentially arranged in this order from the upstream side toward the downstream side in the direction of movement of the belt conveyor 2. The drums 3Y, 3M, 3C and 3K are assigned to yellow (Y), magenta (M), cyan (C) and black (K), respectively. Arranged around the drum 3Y are a charging unit 4Y, an exposing unit 5Y, a developing unit 6Y, an image transferring unit 7 and other electrophotographic process units. Such process units are also arranged around each of the other drums 3M, 3C and 3K, as illustrated.

The discharging unit 9, cleaning unit 10 and so forth are arranged around the belt conveyor 2 at positions downstream of the drum 3K. The fixing unit 11 is positioned downstream of the discharging unit 9 in the direction of sheet conveyance. A sheet conveyed by the belt conveyor 2 via the drums 3Y through 3K is driven out of the apparatus to a print tray, not shown, via the outlet roller 12.

In a full-color mode, for example, the drums 3Y through 3K each are illuminated by associated one of the exposing units 5Y through 5K in accordance with an image signal of particular color. The resulting latent image formed on the drum 3 is developed by toner of particular color and becomes a toner image. Such toner images of four different colors are sequentially transferred from the drums 3Y through 3K to a sheet being conveyed by the belt conveyor 2 one above the other. As a result, a full-color image is formed on the sheet and then fixed by the fixing unit 11.

In a single-color mode using a color S (any one of Y through K), the drums and process units assigned to the other colors are maintained inoperative. Only an exposing unit 5S forms a latent image on a photoconductive drum 3S associated therewith. The latent image is developed by toner of the color S. The resulting toner image is transferred from the drum 3S to a sheet being conveyed by the belt conveyor 2 and then fixed.

Figure 16:
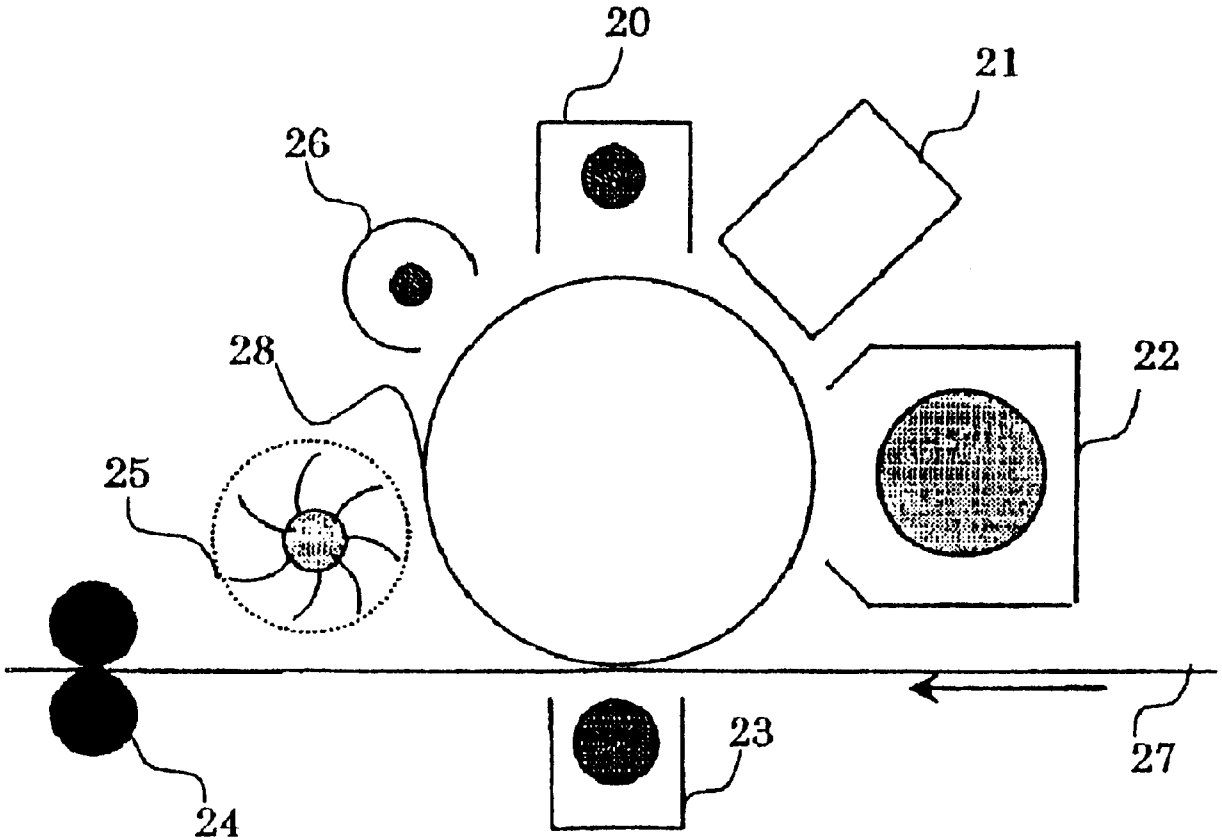
FIG. 16 shows a specific configuration of an image forming apparatus using any one of the illustrative embodiments.

The print head of any one of the previously described embodiments is applied to the exposing unit 21 shown in FIG. 16 or each of the exposing units 5Y through 5K shown in FIG. 17. The print head reduces the diameter of beam spots that illuminate the surface of the drums 28 or the surfaces of the drums 3Y through 3K. This, coupled with the fact that the beam waist adjoins the drum 28 or each of the drums 3Y through 3K, increases the resolution of a latent image or latent images. This is also true with the exposing unit 21, FIG. 16, to which any one of the illustrative embodiments is applied.

In summary, it will be seen that the present invention provides an optical print head capable of reducing the diameter of a beam spot and positioning a beam waist close to an image carrier to thereby increase resolution. The present invention also provides an image forming apparatus using such a print head and therefore capable of printing images with high resolution.

Various modifications will become possible for those skilled in the art after receiving the teachings of the present disclosure without departing from the scope thereof.

What is claimed is:

1. An optical print head comprising:

a light emitting element array comprising a plurality of light emitting elements; and a rod lens array comprising a plurality of rod lenses for focusing light output from said plurality of rod lenses on an image carrier in a form of beam spots;

wherein said plurality of rod lenses each have a conjugate length greater than a distance between said light emitting element array, which forms an image of equi-magnification, and the image carrier.

2. The head as claimed in claim 1, wherein assuming that the conjugate length of said rod lenses is TC, and that the distance between said light emitting element array and the image carrier is TC', then a ratio of TC/TC' satisfies a relation:

$$TC/TC' \geqq 1.02.$$

3. The head as claimed in claim 2, wherein a refractive-index profile constant is varied to thereby increase the conjugate length of said rod lenses.

4. The head as claimed in claim 2, wherein a length of said rod lenses is varied to thereby increase the conjugate length of said rod lenses.

5. The head as claimed in claim 1, wherein a refractive-index profile constant is varied to thereby increase the conjugate length of said rod lenses.

6. The head as claimed in claim 1, wherein a length of said rod lenses is varied to thereby increase the conjugate length of said rod lenses.

7. An image forming apparatus comprising:

an image carrier for forming a latent image thereon; and an exposing unit comprising an optical print head for forming the latent image on said image carrier;

said optical print head comprising:

a light emitting element array comprising a plurality of light emitting elements; and a rod lens array comprising a plurality of rod lenses for focusing light output from said plurality of rod lenses on said image carrier in a form of beam spots;

wherein said plurality of rod lenses each have a conjugate length greater than a distance between said light emitting element array, which forms an image of an equip-magnification, and the image carrier.

8. An optical print head comprising:

a light emitting element array comprising a plurality of light emitting elements; and a rod lens array comprising a plurality of rod lenses for focusing light output from said plurality of rod lenses on an image carrier in a form of beam spots;

wherein a distance between said light emitting element array and the image carrier is smaller than a conjugate length of said plurality of rod lenses.

9. The head as claimed in claim 8, wherein assuming that the distance between said light emitting element array and the image carrier is X, and that the conjugate length of said rod lenses is TC, then there holds a relation:

$$X/TC \leqq 0.98.$$

10. An image forming apparatus comprising:

an image carrier for forming a latent image thereon; and an exposing unit comprising an optical print head for forming the latent image on said image carrier;

said optical print head comprising:

a light emitting element array comprising a plurality of light emitting elements; and a rod lens array comprising a plurality of rod lenses for focusing light output from said plurality of rod lenses on said image carrier in a form of beam spots;

wherein a distance between said light emitting element array and the image carrier is smaller than a conjugate length of said plurality of rod lenses.

* * * * *